US005743149A

United States Patent [19]

Cullity

[11] Patent Number: 5,743,149

[45] Date of Patent: Apr. 28, 1998

[54] ARTICULATED TELESCOPIC BOOM HAVING SLIDE-THROUGH KNUCKLE

[75] Inventor: Richard E. Cullity, Atlantic, Iowa

[73] Assignee: Skyjack Equipment Inc., Atlantic, Iowa

[21] Appl. No.: 607,346

[22] Filed: Feb. 26, 1996

[51] Int. Cl.[6] ..... B66C 23/04

[52] U.S. Cl. ..... 74/490.05; 52/118; 212/348; 212/349; 414/718

[58] Field of Search ..... 414/685, 718, 414/722, 728; 212/230, 264, 296, 348, 349, 350; 52/115, 117, 118; 182/2; 248/286.1; 74/490.05

[56] References Cited

U.S. PATENT DOCUMENTS

| | | | |
|---|---|---|---|
| Re. 27,763 | 9/1973 | Fauchere | 212/348 |
| 3,262,517 | 7/1966 | Malec . | |
| 3,398,492 | 8/1968 | Hansel . | |
| 3,490,701 | 1/1970 | Malec . | |
| 3,667,190 | 6/1972 | Thornton-Trump . | |
| 3,775,798 | 12/1973 | Thornton-Trump . | |
| 4,206,833 | 6/1980 | Goyarts | 182/2 |
| 4,266,908 | 5/1981 | Leiker | 212/230 X |
| 4,757,875 | 7/1988 | Hade, Jr. et al. . | |
| 4,964,778 | 10/1990 | Muto et al. | 414/718 X |
| 5,061,149 | 10/1991 | Lowder et al. | 212/230 X |
| 5,211,077 | 5/1993 | Louis et al. . | |

FOREIGN PATENT DOCUMENTS

2444639A1 12/1978 France .

*Primary Examiner*—Charles A. Marmor
*Assistant Examiner*—Troy Grabow
*Attorney, Agent, or Firm*—Zarley, McKee, Thomte, Voorhees, & Sease

[57] ABSTRACT

An articulated telescopic boom assembly for a lifting device includes a first elongated boom having a central longitudinal axis and an opening in one end; a second elongated boom having a first end normally telescopically received by and extensible from the first boom opening, the first end having at least one elongated pivot guide slot therein having a central longitudinal axis with an open end remote from the first end and a closed end proximate to the first end; and a slide-through knuckle having a housing with an opening therein for receiving the second boom during extension and retraction thereof. The housing is pivotally connected to the first boom by a pair of opposing elongated pins which define a pivot axis. The central longitudinal axis of the pivot guide slot is offset from and perpendicular to the pivot axis such that when the closed end of the guide slot is registered with the pivot pins, the second boom is pivotable. The boom assembly also includes an extensible cylinder connected to the first and second booms for extending and retracting the second boom. The extensible cylinder is pivotally connected to the second boom by a pivot shaft registered with the closed end of the pivot guide slot. The boom assembly includes a hydraulic cylinder pivotally connected to the first boom and the housing for pivoting the housing and thereby the second boom with respect to the first boom.

17 Claims, 6 Drawing Sheets

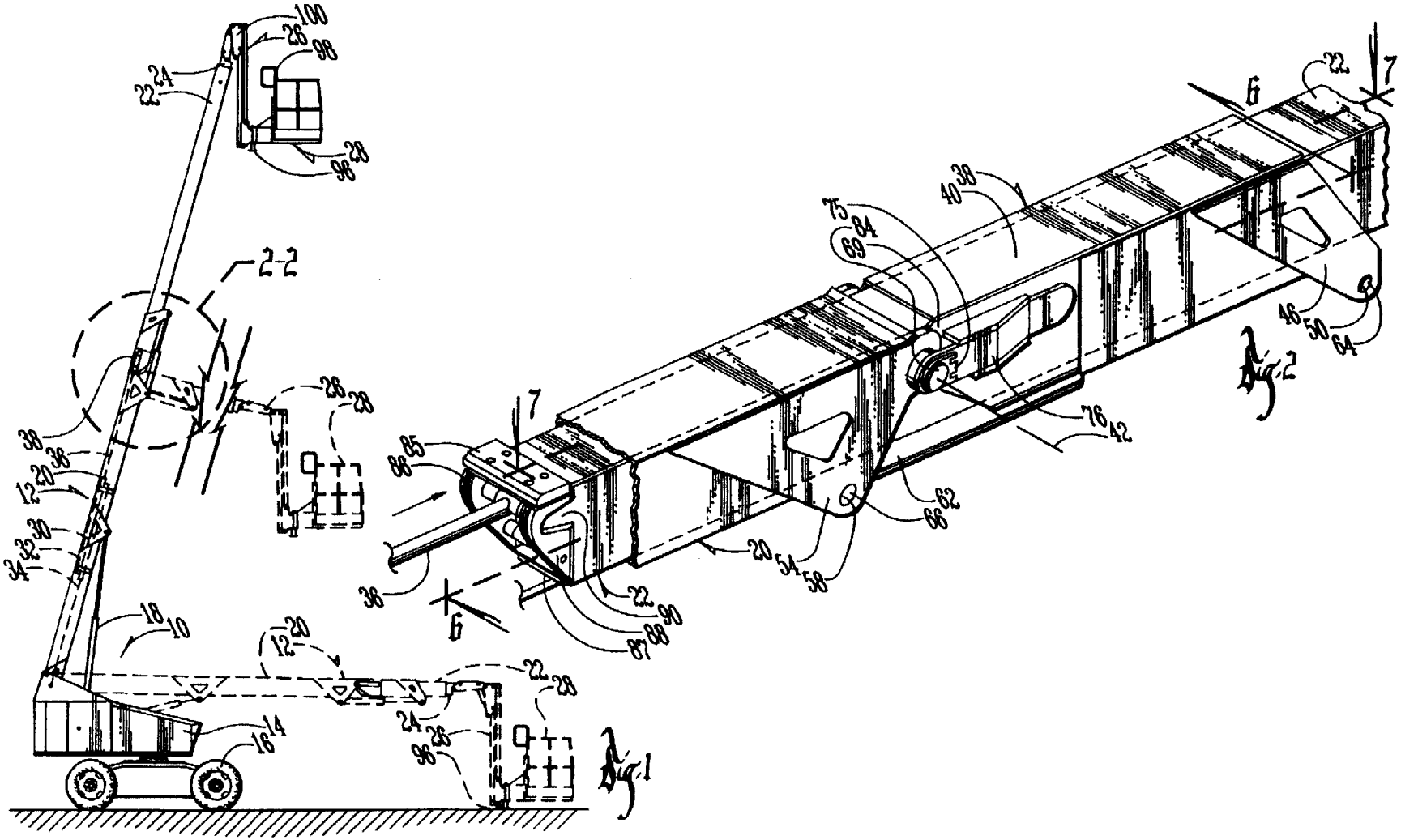

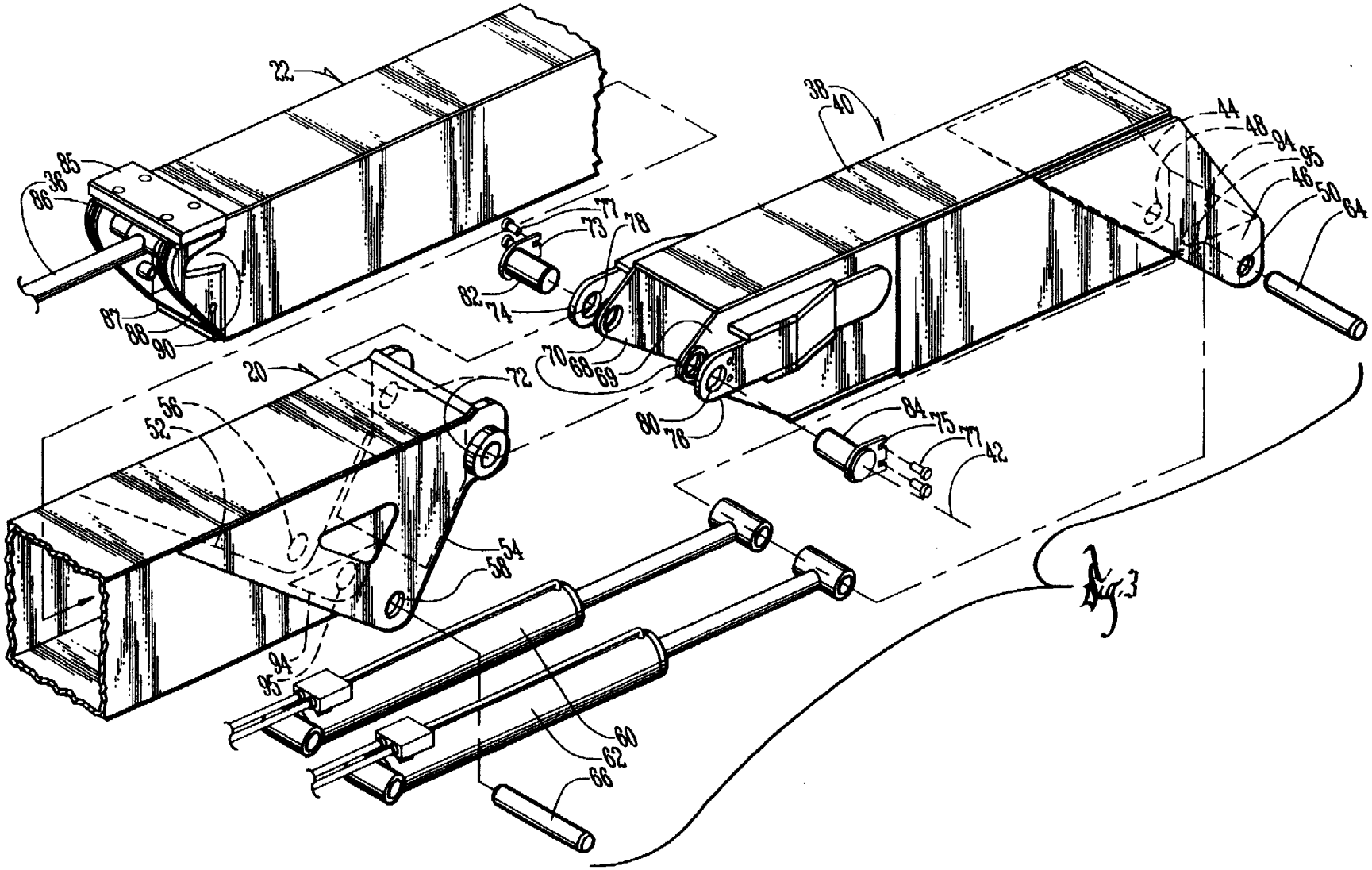

ARTICULATED TELESCOPIC BOOM HAVING SLIDE-THROUGH KNUCKLE

BACKGROUND OF THE INVENTION

The present invention relates to lifting devices having elongated boom assemblies. More particularly, this invention relates to lifting devices having telescopic boom arms. This invention provides a slide-through knuckle joint on a telescopic boom so as to make it articulatable as well as telescopic.

Various types of lifting devices having booms are known in the art. For instance, self-propelled personnel lifts and conventionally articulated lifting cranes typically have multiple telescoping boom sections nested inside of each other. The boom sections are extended and retracted by electronics, hydraulics, mechanics, or some combination thereof.

Generally, the outermost boom tube has the largest cross-section and is pivotally mounted to a turret by a pivot shaft. A hydraulic cylinder is pivotally attached to the turret and the boom so as to move, i.e.—lift and lower, the whole boom arm assembly about the pivot shaft with respect to a horizontal plane. Typically the range of pivotal motion is from seventy-five degrees to minus twenty-five degrees with respect to the horizontal plane.

The conventional boom assembly utilized on these lifts can also be completely retracted or fully extended anywhere within the pivotal working range. Thus, these machines are generally referred to as telescopic or squirt booms.

Other known lifting devices have booms which are made to articulate with a pivotal knuckle. The lowermost boom section has a fixed length and has one end pivotally connected to the turret and another end pivotally connected to a second boom section at the pivotal knuckle. Sometimes the second boom section telescopically receives a third boom section. However, the articulation of the boom limits the degree to which it can be telescopically retracted, thus increasing the space required for storing the boom when not in use. The second and third boom section cannot be telescopically retracted into the lowermost section because of the knuckle.

Therefore, a primary object of the present invention is the provision of an articulated telescopic boom having a slide-through knuckle such that the upper boom section can be telescopically retracted into the lower boom section.

A further object of the present invention is the provision of a slide-through knuckle mechanism for a telescopic boom assembly.

A further object of the present invention is the provision of an articulated telescopic boom assembly having a greater range of movement than existing telescopic boom assemblies without sacrificing the compactability of the boom assembly.

A further object of the present invention is the provision of a knuckle which has a positive mechanical mechanism for ensuring that the knuckle can only pivot with respect to the first boom when the second boom is fully extended, even under manual descent caused by system hydraulic or electrical failure.

These and other objects will be apparent from the drawings, description and claims that follow.

SUMMARY OF THE INVENTION

The present invention is an articulated telescopic boom assembly for a lifting device. The boom assembly has a slide-through knuckle pivotally connecting first and second elongated booms. The first elongated boom has a central longitudinal axis and an end with an opening therein. The second elongated boom has a first end normally telescopically received by and extensible from the opening in the first boom. The first end of the second boom includes at least one elongated pivot guide slot therein having a central longitudinal axis with an open end remote from the first end and a closed end proximate to the first end.

The slide-through knuckle mechanism has a housing with an opening therein for receiving the second boom during extension and retraction thereof with respect to the first boom. The housing is pivotally connected to the first boom by a pair of opposing elongated pins which define a pivot axis.

The central longitudinal axis of the pivot guide slot is offset from and perpendicular to the pivot axis such that upon the second boom being extended so that the pivot pins register with the closed end of pivot guide slot, the second boom is pivotable with respect to the first boom.

An extension means is connected to the first boom and second boom for extending and retracting the second boom with respect to the first boom. The extension means is pivotally connected to the second boom by a pivot shaft registered with the closed end of the pivot guide slot.

A pivoting means is pivotally connected to the first boom and the housing for pivoting the housing and thereby the second boom with respect to the first boom.

BRIEF DESCRIPTION OF THE DRAWINGS

FIG. 1 is a side view of a lifting device having the multiple section articulated telescopic boom of the present invention.

FIG. 2 is an enlarged perspective view of the area denoted 2—2 in FIG. 1.

FIG. 3 is an exploded view of the knuckle mechanism of the present invention.

FIG. 9 is a horizontal cross-sectional view of the boom assembly taken along line 9—9 in FIG. 6.

DETAILED DESCRIPTION OF THE PREFERRED EMBODIMENT

Figure 5:
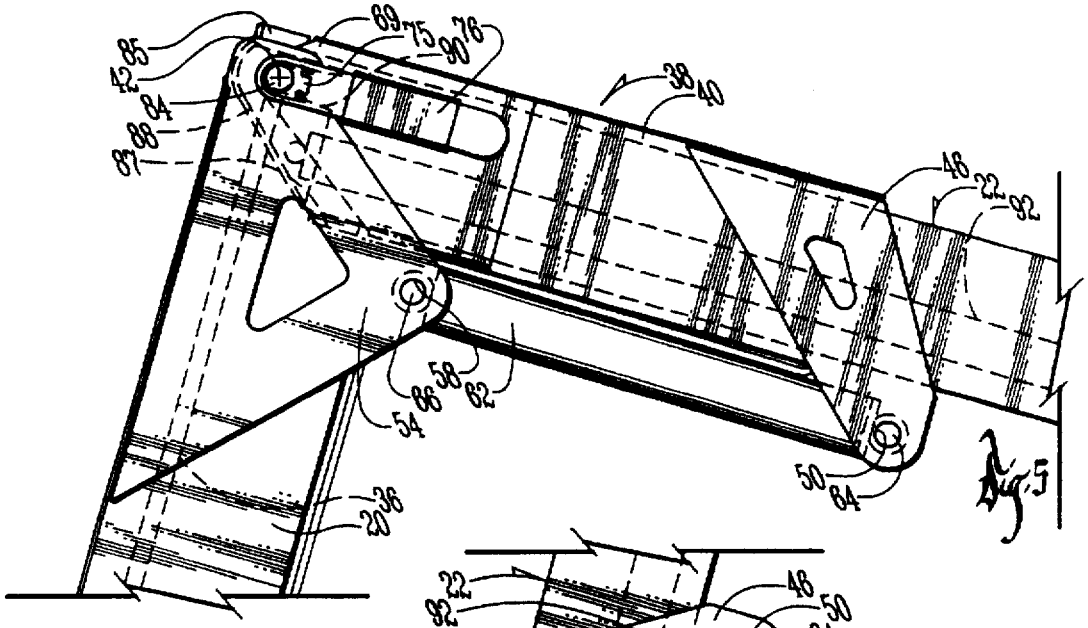
FIG. 5 is an enlarged side view of the knuckle area pivoted to its maximum position.

FIG. 1 shows a lifting device 10 having an articulated telescopic boom assembly 12 according to the present invention. The particular lifting device 10 shown is a personnel lift, but the present invention can be applied to other types of lifting devices including but not limited to cranes.

Personnel lifts can be used to bring people closer to almost any overhead item or structure, including advertising signs, light fixtures, and power, telephone, and cable lines.

The personnel lift 10 has a turret 14 supported and self-propelled on a plurality of wheels 16. The boom assembly 12 pivotally mounts on the turret 14. A hydraulic cylinder 18 interconnects the boom assembly 12 and the turret 14 so as to pivot or raise and lower the boom in a vertical plane.

The boom assembly 12 has multiple sections: an outer boom 20, a mid boom 22, and a fly boom 24. Preferably each of the booms is an elongated tube having a rectangular transverse cross-section. A jib 26 pivotally mounts an operator work platform 28 to the distal end of the fly boom 24. The other end of the fly boom 24 is telescopically received by the mid boom 22. Likewise, the mid boom 22 is telescopically received by the outer boom 20 and a pair of adjacent hydraulic cylinders 30, 32 are mounted in the outer boom 20 approximately midway along its length. Each of the cylinders 30, 32 includes a respective rod 34, 36. The rods 34, 36 extend longitudinally in opposite directions within the outer boom 20. Thus, the cylinders 30, 32 are essentially arranged in a back-to-back or two-way configuration, but the rods 34, 36 can be more fully retracted because of their overlapping side-by-side mounting. The distal end of rod 34 pivotally connects to the lower end of the outer boom 20, while the distal end of rod 36 pivotally connects with lower end of the mid boom 22 as shown in FIGS. 2 and 3. When the mid boom 22 is fully extended, a knuckle mechanism 38 is operable to pivot or articulate the mid boom 22 and the fly boom 24 with respect to the outer boom 20.

Referring to FIGS. 2 and 3, the knuckle mechanism 38 includes a knuckle housing 40 pivotally connected to the upper end of the outer boom 20 along a knuckle pivot axis 42. Offset from the pivot axis 42, the knuckle housing 40 has a pair of ears 44, 46 extending therefrom, one ear being disposed on either side of the housing 40 and extending generally perpendicular to the knuckle pivot axis 42. Holes 48, 50 are provided on ears 44 and 46 respectively. A similar pair of ears 52, 54 with aligned holes 56, 58 are offset in the opposite direction from the pivot axis 42 and extend from the sides of the upper end of the outer boom 20 generally perpendicular to the pivot axis 42.

A knuckle pivoting means, such as dual hydraulic cylinders 60, 62, has one end pivotally attached to the ears 44, 46 on the knuckle housing 40 with a pivot pin 64. The other end of the cylinders 60, 62 pivotally attaches to the ears 52, 54 on the outer boom 20 with a pivot pin 66. Conventional means, such as retaining rings or cotter pins (not shown), retain the pivot pins 64, 66 in their respective holes 48, 50 and 56, 58.

The lower end of the tubular knuckle housing 40, which is closest or proximate to the outer boom 20, is mitered at approximately a forty-five degree angle. The upper end of the outer boom tube 20 has mirror image or complementary shape, which allows the knuckle mechanism 38 to bend to an angle of anywhere from zero to about ninety degrees with respect to the outer boom 20 (see FIG. 5).

The knuckle housing 40, the outer boom 20, and the mid boom 22 pivotally interlock in a novel way. The knuckle mechanism 38 will not bend until the mid boom 22 is fully extended. Yet the fly boom 24 can be telescopically retracted at any time.

Referring again to FIG. 3, the housing 40 has a pair of spaced ears 68, 69 surrounding and extending perpendicular to the pivot axis 42. The ears 68, 69 each include a round hole 70 along the pivot axis 42. Each ear 68, 69 includes an integral outboard bushing around hole 70 for added strength, rigidity and spacing. Tabs 74, 76 mount on each side of the knuckle housing 40 and extend over the respective holes 70. The tabs 74, 76 each have round holes 78, 80 therein registered with the corresponding holes 70.

Figure 7:
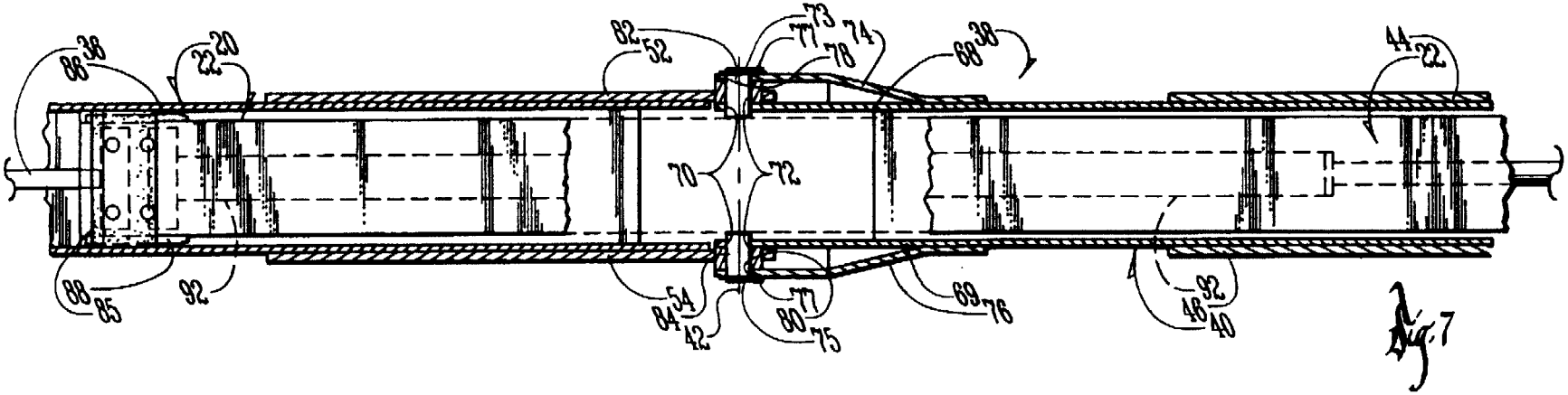
FIG. 7 is a horizontal cross-sectional view taken along line 7—7 in FIG. 2, again showing the mid boom in a nonpivotable position.
Figure 7:
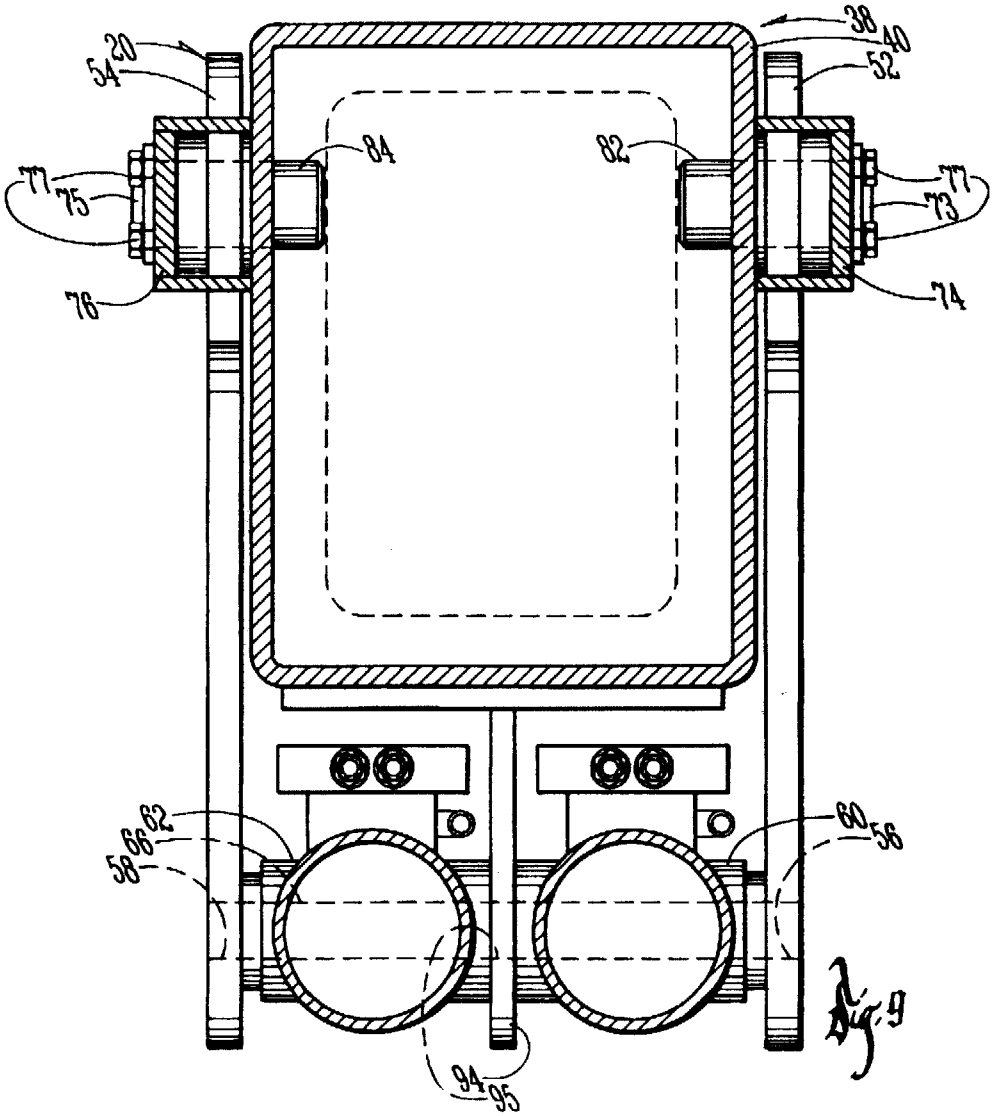

The outer boom 20 has a pair of identical and coaxial holes 72 extending therethrough adjacent one of its ends. The outer boom 20 and the housing 40 are positioned so as to align or register each of the holes 70, 72, 78, and 80 with each other. A pin 82 has a head and an elongated shaft which extends through the holes 78 in the housing 40, 72 in the outer boom 20, and 70 in the housing 40. A similar pin 84 extends through the holes 80 in the housing 40, 72 in the outer boom 20, and 70 in the housing 40. Together the pins 82, 84 define the knuckle pivot axis 42. As best seen in FIG. 7, the ends of the pins 82 and 84 extend into the outer boom 20 and abut the mid boom 22 telescopically disposed thereinside. Retaining tabs 73, 75 mounted to tabs 74, 76 by fasteners 77 restrain the pins 82, 84 against axial movement once installed.

The mid boom 22 includes opposite pivot yokes 86, 88 attached to the sides of its proximate end. Each pivot yoke 86, 88 has a parabolic slot 90. The rearward end of each slot 90 is flared open to guidingly receive one of the pivot pins 82, 84 as the mid boom 22 slidingly approaches its fully extended position. The forward end of each slot 90 is rounded closed and is positioned such that the pin 82 or 84 registers with it, or preferably abuts it, when the mid boom 22 is fully extended. Thus, the present invention provides a positive mechanism for ensuring the knuckle 38 is in a pivotable condition. Each slot 90 has a central longitudinal axis which is perpendicular to the pivot axis 42.

Figure 4:
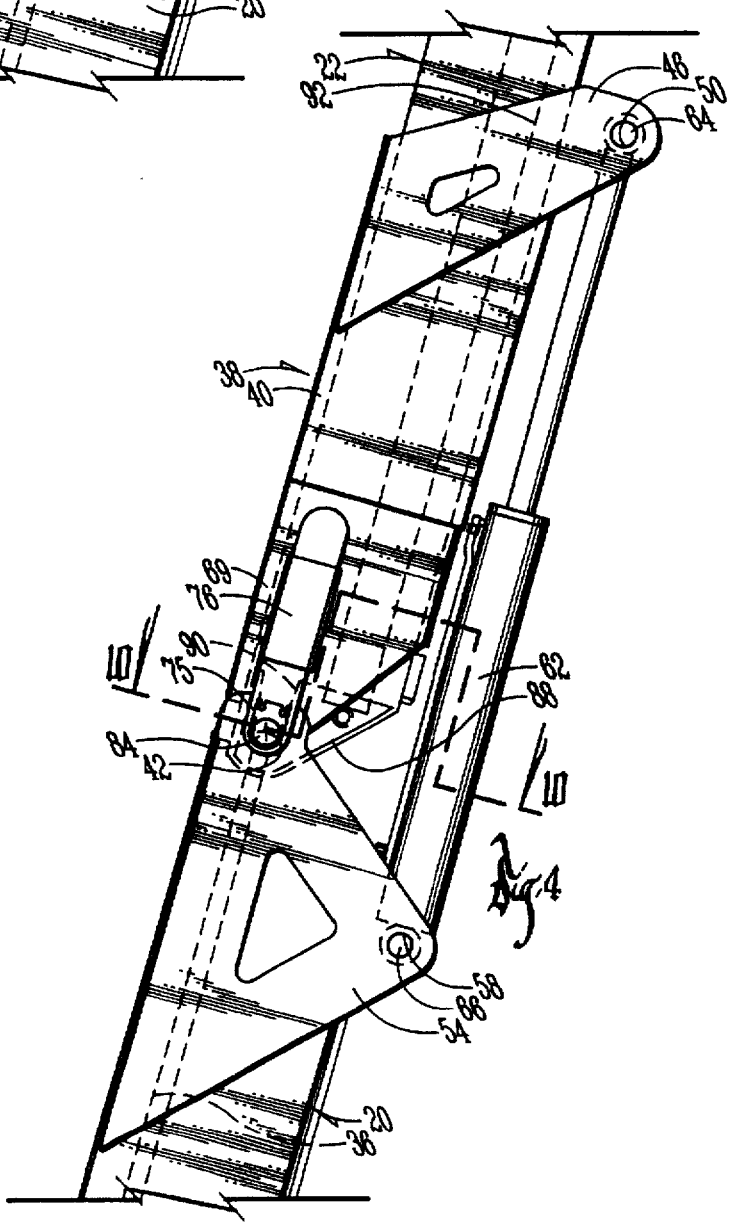
FIG. 4 is an enlarged side view of the knuckle area when the knuckle is ready to pivot.
Figure 6:
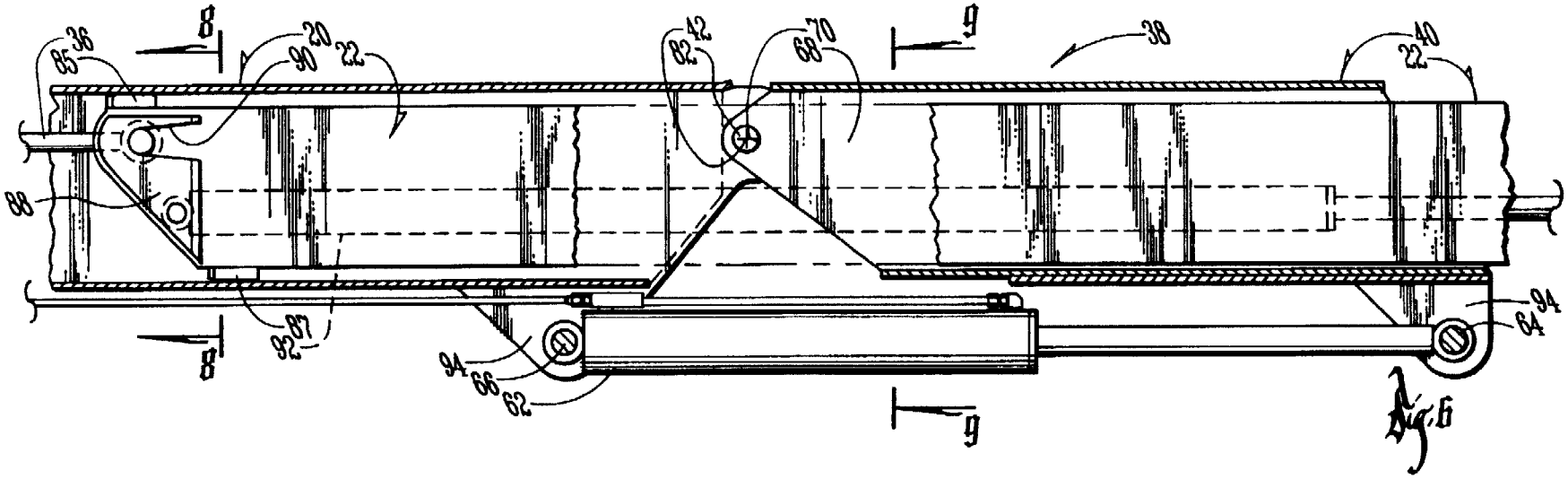
FIG. 6 is a vertical cross-sectional view taken along line 6—6 in FIG. 2. This figure shows the booms joined by the knuckle as the mid boom spans or slides through the knuckle while it approaches or is retracted from its pivotable position.

Referring to FIGS. 2–4, guide bushing blocks 85, 87 mount to top and bottom of the mid boom 22 at its proximate end. The guide bushing blocks 85, 87, along with the pivot yokes 86, 88, steady the mid boom 22 within the outer boom 20 and the knuckle housing 40. Preferably the bushing blocks 85, 87 are constructed of a suitable sliding bearing material, such as plastic or the like.

FIG. 4 shows the knuckle mechanism 38 in a pivotable condition wherein the mid boom 22 is fully extended, the pins 82 (see FIG. 7) and 84 pivotally rest in the closed forward ends of the slots 90, and the hydraulic cylinders 60 (see FIG. 7) and 62 are extended between the ears 44, 52 (see FIG. 7) and 46, 54. Note that the rod 36, which extends and retracts the mid boom 22, has a pivotal connection therewith that is coaxial with the pivot axis 42 of the knuckle mechanism 38 and registered with the closed end of the pivot guide slot 90. A fly boom extension cylinder 92 has one end mounted in the mid boom 22 and another end (not shown) mounted in the fly boom 24. Thus, the cylinder 92 is operably independent of the outer boom 20.

FIG. 5 shows the hydraulic cylinders 60 (hidden in FIG. 5, but see FIG. 3) and 62 fully retracted, which causes the mid boom 22 to be pivoted to its maximum angle $\alpha$, about ninety degrees, with respect to the outer boom 20. By varying the amount of cylinder retraction, a pivot or bend angle $\alpha$ of anywhere from about zero to ninety degrees can be achieved.

Figure 8:
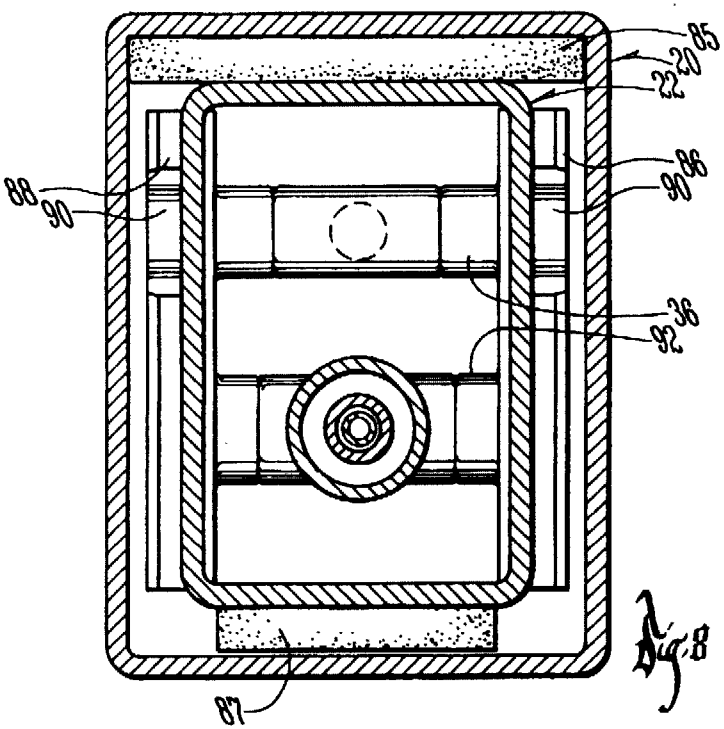
FIG. 8 is a horizontal cross-sectional view of the boom assembly taken along line 8—8 in FIG. 6.
Figure 10:
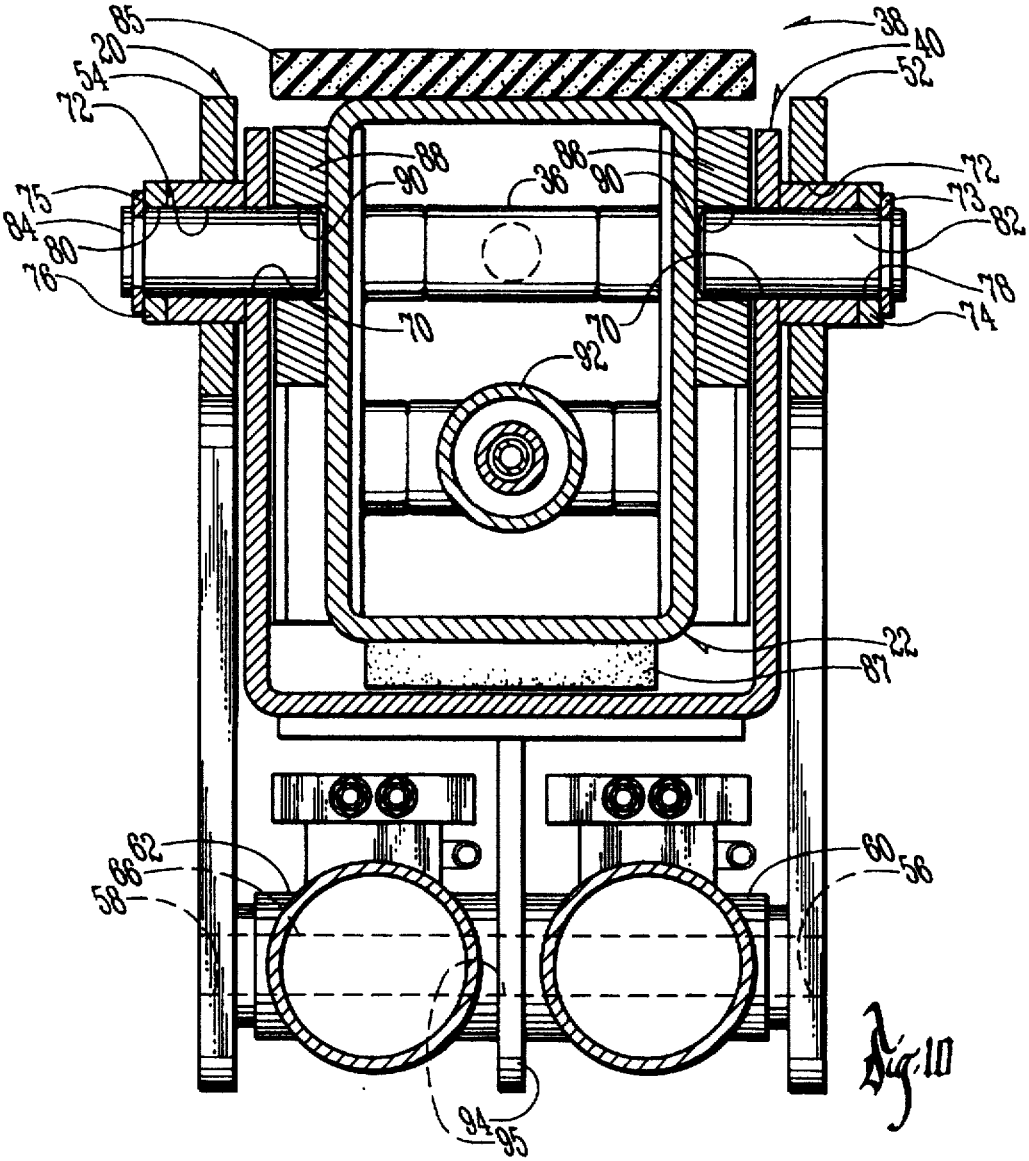
FIG. 10 is a horizontal cross-sectional view of the boom assembly at the knuckle area taken along line 10—10 in FIG. 4 and shows the mid boom fully extended into its pivotable position.

FIG. 8 is a cross-sectional view showing the proximate end of the mid boom 22 telescopically disposed within the outer boom 20 before being fully extended and reaching the pivot axis 42. FIG. 9 shows the opposing pivot pins 82, 84 extending through the knuckle housing 40 into positions adjacent the mid boom 22. FIGS. 9 and 10 show the mid boom 22 approaching the knuckle 38 and in the pivotable position respectively. A middle support bracket 94 is attached to the bottom of the outer boom 20. The bracket 94 has a hole 95 therein which receives, guides and supports the pin 66 similar to holes 56, 58 (see FIG. 9). In FIG. 3, a similar bracket 94 is shown attached to the knuckle housing 40 so as to support pin 64.

In use, the articulated boom assembly 12 can be placed in wide variety of positions, including the lowermost position shown in dotted lines in FIG. 1 where boom assembly is basically horizontal and the platform 28 is placed with its foot 96 resting on the ground. In this position, the operator can board the platform 28 and assume control of the boom assembly 12 and the platform through a control panel 98 mounted thereon. If the operator needs to access a relatively high area, the boom assembly 12 can be pivoted upwardly to a greater angle, such as the position shown in solid lines in FIG. 1. A conventional leveling mechanism 100 pivotally connects the platform 28 with the jib 26 and maintains the platform 28 in a level orientation. If the operator needs to reach even higher, the fly boom 24 can be extended from the mid boom 22 until the desired height is reached.

However, sometimes the operator would like the platform 28 to be telescopically extensible in a horizontal direction or along a vector between zero and about ninety degrees from the upward projection of the outer boom 20. In that case, the mid boom 22 is fully extended. Then the mid boom 22 is pivoted with respect to the outer boom 20 with the knuckle mechanism 38. Thereafter, the platform 28 is movable along the vector or angle $\alpha$ by merely extending or retracting the fly boom 24 with respect to the mid boom 22. One skilled in the art will appreciate that a new dimension of flexibility has been added by the present invention, making it possible to access work areas not heretofore reachable with similar existing equipment, including elevations both above and below ground level (for example, for bridge inspections).

Based upon the foregoing, the present invention at least satisfies its stated objectives.

What is claimed is:

1. An articulated telescopic boom assembly for a lifting device, comprising:

a first elongated boom having a central longitudinal axis and opposite ends, one of the ends having an opening therein;

a second elongated boom having a first end normally telescopically received by and extensible from the opening in the first boom, the first end including at least one elongated pivot guide slot thereon having a central longitudinal axis and an open end remote from the first end and a closed end proximate to the first end;

a slide-through knuckle mechanism having a housing with an opening therethrough for receiving the second boom during extension and retraction thereof with respect to the first boom, the housing being pivotally connected to the first boom by a pair of opposing elongated pins disposed coaxially to define a pivot axis;

the central longitudinal axis of the pivot guide slot being perpendicular to the pivot axis such that upon the second boom being extended so that the pivot pins register with the closed end of pivot guide slot the second boom is pivotable with respect to the first boom;

extension means connected to the first boom and the second boom for extending and retracting the second boom with respect to the first boom, the extension means being pivotally connected to the second boom by a pivot shaft registered with the closed end of the pivot guide slot; and means pivotally connected to the first boom and the housing for pivoting the housing and thereby the second boom with respect to the first boom.

2. The boom assembly of claim 1 wherein the means for pivoting the housing with respect to the first boom comprises a hydraulic cylinder having one end pivotally connected to the first boom remote from the pivot axis and one end pivotally connected to the housing remote from the pivot axis.

3. The boom assembly of claim 1 wherein the first boom is a tubular outer boom.

4. The boom assembly of claim 1 wherein the extension means on the first boom comprises a pair of hydraulic cylinders mounted adjacent to each other, each of the cylinders having a rod extensible therefrom, one of the rods being extensible in a first direction and pivotally connected to the first boom, whereas the other of the rods being extensible in a second opposite direction and pivotally connected to the second boom.

5. The boom assembly of claim 1 wherein the second boom is a tubular mid boom having a second end with an opening therein and the boom assembly further comprises a fly boom telescopically received by and extensible from the opening in the mid boom by a fly boom extension means having one end mounted in the mid boom and another end mounted to the fly boom, the fly boom extension means being operably independent of the first boom.

6. The boom assembly of claim 5 wherein the second boom has top, bottom, and opposite side surfaces.

7. The boom assembly of claim 6 comprising two elongated pivot guide slots, one guide slot being located on each side surface of the second boom respectively such that the slots are registered with each other.

8. The boom assembly of claim 7 further comprising two pivot yolk plates, one of the plates being mounted to each of the side surfaces of the second boom respectively and the pivot guide slots being formed therein.

9. The boom assembly of claim 5 wherein the fly boom extension means includes only one hydraulic cylinder.

10. The boom assembly of claim 5 further comprising a jib mounted to the fly boom, an operator work platform, and a leveling mechanism pivotally connected to the jib and the platform.

11. The boom assembly of claim 5 wherein the fly boom is an elongated tube.

12. The boom assembly of claim 5 wherein the first boom, mid boom and fly boom each include an elongated body comprising a rectangular tube.

13. The knuckle mechanism of claim 1 wherein the housing has a first pivot hole therein and the first boom has a second pivot hole therein and the pivotal connection between the tubular housing and the first boom comprises the first and second pivot holes being registered with each other and a first pivot pin being inserted into said registered pivot holes so as to together define the pivot axis.

14. The knuckle mechanism of claim 13 wherein the housing has a third pivot hole therein registered with the first pivot hole and the first boom has a fourth pivot hole therein registered with the second pivot hole and the pivotal connection between the tubular housing and the first boom further comprises the third and fourth pivot holes being registered with each other and a second pivot pin being inserted into said registered third and fourth pivot holes, the first and second pivot pins being coaxial but of fixed length such that the pins are axially spaced apart on the pivot axis sufficiently to allow the second boom to slide therebetween.

15. The knuckle mechanism of claim 14 wherein the first and second pivot pins each comprise an elongated shaft with a head protruding radially therefrom.

16. The knuckle mechanism of claim 1 wherein first boom comprises a hollow tube and the captive end of the second boom is telescopically extensible from inside the first boom.

17. A knuckle mechanism in a multiple section telescopic boom having a first boom and a second boom having a captive end telescopically received by the first boom, comprising:

a tubular housing having one end pivotally connected to the first boom along a pivot axis and having an opening therein which telescopically receives the second boom therethrough;

means pivotally connecting the first boom and the housing so as to pivot the housing and the second boom about the pivot axis with respect to the first boom when the second boom is extended from the first boom such that the captive end is aligned with the pivot axis;

the housing having a first pivot hole therein and the first boom having a second pivot hole therein and the pivotal connection between the tubular housing and the first boom comprising the first and second pivot holes being registered with each other and a first pivot pin being inserted into said registered pivot holes so as to together define the pivot axis;

the housing having a third pivot hole therein registered with the first pivot hole and the first boom having a fourth pivot hole therein registered with the second pivot hole and the pivotal connection between the tubular housing and the first boom further comprising the third and fourth pivot holes being registered with each other and a second pivot pin being inserted into said registered third and fourth pivot holes, the first and second pivot pins being coaxial but of fixed length such that the pins are axially spaced apart on the pivot axis sufficiently to allow the second boom to slide therebetween;

the first and second pivot pins each comprising an elongated shaft with a head protruding radially therefrom; and a pair of retaining tabs each having a hole therein for receiving the shaft of one of the pivot pins, each of the retaining tabs being attached to the respective pivot pin and detachably mounted to the housing so as to prevent axial movement of the pivot pin.

* * * * *